US011225087B2

(12) United States Patent
Breton

(10) Patent No.: US 11,225,087 B2
(45) Date of Patent: Jan. 18, 2022

(54) METHOD OF CONTROLLING A HAND-OPERATED PRINTER AND HAND OPERATED PRINTER

(71) Applicant: COLOP Digital GmbH, Wels (AT)

(72) Inventor: Alex Breton, Enskede Gard (SE)

(73) Assignee: COLOP Digital GmbH, Wels (AT)

( * ) Notice: Subject to any disclaimer, the term of this patent is extended or adjusted under 35 U.S.C. 154(b) by 0 days.

(21) Appl. No.: 17/253,941

(22) PCT Filed: Jun. 25, 2019

(86) PCT No.: PCT/EP2019/066803
§ 371 (c)(1),
(2) Date: Dec. 18, 2020

(87) PCT Pub. No.: WO2020/002317
PCT Pub. Date: Jan. 2, 2020

(65) Prior Publication Data

US 2021/0260890 A1 Aug. 26, 2021

(30) Foreign Application Priority Data

Jun. 25, 2018 (EP) ..... 18179483

(51) Int. Cl.
*B41J 3/36* (2006.01)
*B41J 2/145* (2006.01)
*B41J 29/393* (2006.01)

(52) U.S. Cl.
CPC ..... *B41J 3/36* (2013.01); *B41J 2/145* (2013.01); *B41J 29/393* (2013.01)

(58) Field of Classification Search
CPC ..... B41J 3/36; B41J 2/145; B41J 29/393
See application file for complete search history.

(56) References Cited

U.S. PATENT DOCUMENTS

| | | | |
|---|---|---|---|
| 5,018,026 | A | 5/1991 | Takada |
| 5,927,872 | A | 7/1999 | Kamada |
| 6,357,939 | B1 | 3/2002 | Baron |
| 6,773,177 | B2 | 8/2004 | Denoue et al. |

(Continued)

FOREIGN PATENT DOCUMENTS

| | | | |
|---|---|---|---|
| CN | 2351280 | Y | 12/1999 |
| CN | 1630585 | A | 6/2005 |

(Continued)

OTHER PUBLICATIONS

International Search Report and Written Opinion of the International Searching Authority for International Patent Application No. PCT/EP2019/066803 dated Aug. 22, 2019, 11 pages.

(Continued)

*Primary Examiner* — Lamson D Nguyen
(74) *Attorney, Agent, or Firm* — Merchant & Gould P.C.

(57) ABSTRACT

A method of controlling a hand-operated printer (3) includes detecting a transverse movement of the hand-operated printer (3) after finishing a first swath (1). The method compares a transverse distance covered by the transverse movement with a predetermined transverse distance (11) between said first swath (1) and a second swath (2). A transverse-stop signal is emitted when the transverse distance covered by the transverse movement reaches the predetermined transverse distance (11).

15 Claims, 2 Drawing Sheets

(56) References Cited

U.S. PATENT DOCUMENTS

| | | | | |
|---|---|---|---|---|
| 6,942,402 | B1 | 9/2005 | Slupe et al. | |
| 7,735,951 | B2 | 6/2010 | Ahne et al. | |
| 8,107,108 | B1 | 1/2012 | McKinley et al. | |
| 8,210,758 | B2 | 7/2012 | Gates | |
| 2007/0052766 | A1* | 3/2007 | Trauernicht | B41J 2/16517 347/73 |
| 2007/0092325 | A1 | 4/2007 | Studer et al. | |
| 2007/0120937 | A1 | 5/2007 | Ahne | |
| 2007/0139508 | A1 | 6/2007 | Muyskens | |
| 2008/0024576 | A1* | 1/2008 | Kim | B41J 29/023 347/101 |

FOREIGN PATENT DOCUMENTS

| | | | |
|---|---|---|---|
| CN | 101675655 | A | 3/2010 |
| JP | 2004-508218 | A | 3/2004 |

OTHER PUBLICATIONS

Extended European Search Report for European Patent Application No. 18179483.5 dated Jan. 2, 2019, 10 pages.
Chinese Office Action for Chinese Patent Application No. 201980042589.2 dated Sep. 29, 2021, 22 pages.

* cited by examiner

METHOD OF CONTROLLING A HAND-OPERATED PRINTER AND HAND OPERATED PRINTER

This application is a National Stage Application of PCT/EP2019/066803, filed 25 Jun. 2019, which claims benefit of European Patent Application Serial No. 18179483.5, filed 25 Jun. 2018, and which applications are incorporated herein by reference. To the extent appropriate, a claim of priority is made to each of the above-disclosed applications.

BACKGROUND OF THE INVENTION

The invention concerns a hand-operated printer, a method of controlling a hand-operated printer, a method for preparing a hand-operated printer for printing an image in multiple swaths using said method, and computer program products implementing said methods. The hand-operated printer (also "electronic hand stamp") generally is a portable electronic device for producing stamp marks by printing on a substrate (e.g. a document or other object to be stamped). A hand-operated printer of the present type comprises an inkjet printhead with nozzles directed toward a bottom side of the electronic hand stamp, a control circuit, and a motion detector, wherein the control circuit is connected to the motion detector and to the inkjet printhead and configured to control the inkjet printhead in response to readings received from the motion detector, thereby producing a printed image when the hand-operated printer is manually moved over a target medium.

Inkjet printheads have a limited number of nozzles. The arrangement of these nozzles, more specifically the distance between the nozzles, determines the achievable resolution of the printed image and the width of a swath (swath width) on a target medium that can be printed in one pass of the printhead. The swath length is limited only by the dimension of the target medium (and theoretically by the ink content of and ink cartridge if that is how the printhead is supplied with ink). If both dimensions of the image to be printed are larger than the swath width, it is known to print two or more swaths at different positions subsequently with the same printhead. That is how desktop inkjet printers work. There are several limitations of those devices: they are bulky, heavy and relatively expensive; also, they can be used only with a target medium that can be fed into the feed mechanisms those printers provide (e.g. paper feed).

In order to provide printers that are more compact, portable and affordable, it has been known to dispense with the paper transport and the mechanics for moving the printhead and instead provide a hand-operated printer, i.e. one that is moved over the target medium by hand while printing. Example of such devices are disclosed in U.S. Pat. Nos. 5,927,872 and 6,773,177. Those devices measure the relative movement of the printer over the target medium in both directions and recognise when a new swath shall be printed. More specifically, they are based on an alignment of subsequent stacked swaths by means of controlling the printhead to account for a detected path of movement of the printhead over the target medium, wherein the user can move the printer freely over the target medium. In our experience, the precision achieved with available motion sensors for detecting relative movements (e.g. optical sensors) does not suffice to achieve an acceptable print quality with this method, because the measurement errors and thus the alignment errors accumulate over the distance covered with the printhead. As a result, printing of continuous and partially overlapping swaths most of the time results in unclean printed images due to insufficient alignment of the respective swaths.

A known approach to avoid those errors is based on the recognition that by replacing or complementing the detection of relative movements with a detection of an absolute position with respect to the printed image should allow to avoid the above-mentioned accumulation of errors. This approach includes scanning the already printed image and performing image recognition on the scanned image in order to determine a position of the scanned image within the image to be printed and use this information for correcting the alignment. Obviously, this approach requires powerful hardware for scanning and image recognition, which is in conflict with the intention to provide a simple and affordable device.

A more cost-efficient approach is disclosed in U.S. Pat. No. 7,735,951. It includes printing alignment marks together with the image to be printed and thereby facilitating manual vertical/transverse alignment. In particular, the user would align the printed alignment mark of a previous swath with a reference marking on the printer before printing the subsequent swath. This approach has the obvious disadvantage that the printed image is mangled with the printed alignment marks.

Other known devices display the progress of the printing process on a graphical screen in order to inform the user of missing areas, over which they should move the printhead to complete the printed image. The resolution of those screens is not sufficient and too low to enable an acceptable alignment of subsequent swaths. Examples of such devices are disclosed in U.S. Pat. Nos. 6,942,402 and 8,107,108.

With a different purpose, namely to guide the user through a sequence of separate images to be printed, US 2007/092325 A1 discloses a device that generates audible sounds instructing the user of a position of a subsequent image once the present image is complete. There is no active guidance from the printer concerning the precise alignment for printing the subsequent image.

US 2007/120937 A1 concerns a handheld printer, which is moved manually over a surface to be printed on. The printer detects the direction of a horizontal movement (from left to right or vice versa) and adjusts to be detected direction. The disclosure of US 2007/120937 A1 is limited to the processing of horizontal movement, i.e. in a direction parallel to a swath, and therefore does not concern the alignment of different swaths.

U.S. Pat. No. 6,357,939 B shows another (seemingly hypothetical) handheld printer with a basically circular optical sensor surrounding a printhead. Apparently, this printer may be moved in arbitrary directions over the surface until all portions of an image have been printed. The printer comprises a visual or audio indicator, which indicates completion of printing.

U.S. Pat. No. 8,210,758 B2 concerns yet another handheld printer capable of detection and determining the distance of a horizontal movement as well as providing general user guidance concerning the movement of the printer, e.g. by indicating yet unprinted parts on a display. The problem of aligning subsequent swaths is not addressed specifically.

SUMMARY OF THE INVENTION

It is an object of the present invention, to aid the user in achieving an acceptable alignment of subsequent swaths with a relatively simple and affordable device.

The invention proposes a method of controlling a hand-operated printer, comprising: detecting a transverse movement of the hand-operated printer after finishing a first swath, comparing (i.e. monitoring continuously) a transverse distance covered by the transverse movement with a predetermined (for example predefined) transverse distance between said first swath and a second swath, and emitting a transverse-stop signal when the transverse distance covered by the transverse movement reaches the predetermined transverse distance.

Correspondingly, the invention proposes a hand-operated printer as defined in the outset, further comprising a signalling unit connected to the control circuit, wherein the control circuit is configured to monitor a transverse movement detected by the motion detector between a first swath and a second swath, compare a transverse distance covered by the transverse movement with a predetermined transverse distance between said swaths and command the signalling unit to emit a stop signal when the transverse distance covered by the transverse movement reaches the predetermined transverse distance. The motion detector may be e.g. an optical mouse encoder that provides readings in counts per centimetre or per inch.

In other words, the invention suggests to continuously monitor the transverse displacement of the printer after the first swath is finished and notify the user with a transverse-stop signal at the moment the transverse displacement should be stopped and printing of the second swath should begin. The transverse-stop signal provides for a momentary notification of a sufficient transverse movement or displacement. By slowly and attentively performing the transverse displacement, the user can achieve a precision of alignment that is comparable or exceeds that achieved by the known alignment marks, albeit without the disadvantage of mangling the printed image.

Advantageously, the predetermined transverse distance is larger than the average swath width of the first swath and second swath by a predefined transverse padding. Here, the swath width refers to the width of the actual used swath, which may be smaller than the maximum possible swath width determined by the nozzle parameters. For instance, several intentionally narrow swaths (i.e. having a swath width smaller than the maximum possible swath width) may be used to print lines separated by a line spacing, wherein two lines would not fit into a single swath at the maximum swath width. The average swath width of the first swath and the second swath corresponds to the distance between the centrelines of the two swaths. The predefined transverse padding allows to account for alignment errors and resulting swath overlaps by enforcing a minimum distance between subsequent swaths. The optimum predefined transverse padding also depends on the accuracy of the motion sensor(s), wherein better sensor accuracy allows for smaller transverse padding. The predefined transverse padding may be between 0.1 and 3 mm, preferably approximately 1 mm.

Furthermore, the predetermined transverse distance may be determined as a function of a path of a longitudinal movement of the hand-operated printer during printing the first swath. For example, the printer might be able to actively compensate for a bending in the path followed by a user for anatomic reasons (with the centre at the elbow) by balancing the position of the image with respect to the swath according to a detected offset from a straight path. In these instances, the predetermined transverse distance can be increased or reduced in order to balance the transverse displacement over the length of the swath that presumably will be observed also during the subsequent swath.

The transverse-stop signal can be an audible, visual or haptic signal (e.g. sound, noise, blink of a light, colour change of a light, switch-off of a light, vibration). Preferably, the transverse-stop signal is an audible signal because the user will visually focus on the target medium. Actors for producing a haptic signal are relatively more expensive and may also give an impression of causing misalignment. Within the scope of the invention, the transverse-stop signal may also be an electric or radio signal, which is converted to a notification perceivable by a user of the hand-operate printer by a separate device (e.g. a smartwatch or external speaker). Correspondingly, the signalling unit of the hand-operated printer is preferably a speaker, a light (e.g. LED) or a vibration motor.

With respect to multiple swaths applied to the target medium during printing, at least one end of each that the last swath is transversely aligned with a beginning of an adjacent swath. Preferably, the multiple swaths are essentially parallel, in particular transversely stacked swaths. Here, the terms "end" and "beginning" are relative to the longitudinal direction of movement. For a swath that is applied by moving the printer from left to right, the left-hand border is the beginning, whereas for a swath that is applied by moving the printer from right to left, the right-hand border is the beginning.

It has turned out advantageous, if the method comprises signalling the end of a swath by emitting a longitudinal-stop signal after finishing the first swath. The longitudinal-stop signal might differ from the transverse-stop signal only in the moment of production or emission, i.e. the same sound or noise might be used for the longitudinal-stop signal and the transverse-stop signal. In particular, a longitudinal-stop signal can be emitted at the end of each of the multiple swaths. It is noteworthy, that the longitudinal-stop signal is not necessary, because an over-shooting movement, i.e. further than required for printing a segment of the image to be printed, which segment is assigned to the present swath, can be compensated by adding corresponding longitudinal padding to the subsequent swath. Nevertheless, it is advantageous to minimise the distance covered by the longitudinal movement to the distance required for printing said segment, in order to reduce misalignment of subsequent swaths that would be effectively amplified by larger distances.

In this context it is of particular advantage, that the method comprises signalling the end of a swath depending on the printed area of the present swath, on a longitudinal direction of movement of the hand-operated printer, and on the beginning of the printed area of the subsequent swath. The longitudinal direction of movement determines, which border of the present swath is its end and which border of the subsequent swath is its beginning. The printed area (or more precisely, the area to be printed, or simply "content") associated with each swath determines the relative position and longitudinal extension (or simply "length") of the respective swath. The right moment for emitting the longitudinal-stop signal not only depends on the content of the present swath, but also on the content of the subsequent swath. Since the longitudinal direction of movement of the subsequent swath will often be inverse to the longitudinal direction of movement of the present swath, the printer would essentially be moved in the longitudinal direction not only until after the content of the present swath but also until after the content of the subsequent swath.

Since the present method may support stacking of swath in both transverse directions (e.g. top-down or bottom-up), it can be helpful to guide the user by indicating a direction of transverse movement after finishing the first swath.

In a preferred embodiment the present method comprises switching the hand-operated printer between a print mode and a translation mode, in print mode detecting a longitudinal movement of the hand-operated printer and controlling a printhead of the hand-operated printer in accordance with the detected longitudinal movement to print an image content of a present swath, and in translation mode controlling the printhead to remain idle. Print mode essentially corresponds to the mode of operation of known hand-operated printers. Those can be switched between a print mode and a standby mode, where the printer is inactive. The present method comprises a third mode, translation mode, where the printer actively tracks its movement on the target medium and the printhead remains idle. Specifically, no partial swaths will be printed in translation mode. Any printing can happen only in print mode.

In this context, the present method preferably comprises switching the hand-operated printer from translation mode into print mode at the same time as emitting the transverse-stop signal. The moment when the transverse-stop signal is emitted indicates that the transverse movement of the printer is complete and the printer has reached a position for printing the second or subsequent swath.

When the method comprises emitting a longitudinal-stop signal, preferably it also comprises switching the hand-operated printer from print mode into translation mode at the same time as emitting the longitudinal-stop signal. The moment when the longitudinal-stop signal is emitted indicates that the logic to the movement of the printer is complete and the printer can be moved to the next transverse position for printing the second or subsequent swath.

Advantageously, in print mode a direction of the longitudinal movement is determined during printing the first swath, wherein a direction of the longitudinal movement during subsequent swaths is assumed to be inverse to the direction of the previous swath. Subsequent swaths are thus printed in alternating longitudinal directions, i.e. by repeatedly moving the hand-operated printer alternately in a longitudinal direction for printing a swath and in a transverse direction between the end of a swath and the beginning of a subsequent swath. Correspondingly, the control circuit of the hand-operated printer is preferably configured to detect a direction of longitudinal movement for printing the first swath and to assume alternating directions of longitudinal movement for the subsequent swaths.

Within the scope of the present invention, it therefore also comprises a method for printing an image comprising at least two non-overlapping image segments, the method comprising: detecting a direction and distance of movement, tracking longitudinal and transverse movements, printing a first swath, moving the hand-operated printer in a transverse direction relative to the first swath, emitting a transverse-stop signal for transverse movement, and printing a second swath transversely stacked with respect to the first swath.

The invention further provides a computer program product for printing multiple swaths with a hand-operated printer, the computer program product comprising program parts, which when loaded onto a computer are designed to perform the method steps of the method as described above or of one of its preferred embodiments.

Moreover, the invention provides a method for preparing a hand-operated printer for printing an image in multiple swaths using a method as described above or one of its preferred embodiments, comprising: identifying image parts separated by parallel straight gaps of a predefined minimum gap width, assigning adjacent identified image parts to subsequent swaths, and transmitting image data associated with each swath and alignment information of all swaths to a hand-operated printer. In preparing a given image to be printed for printing with the hand-operated printer, the method therefore assigns image parts separated by a straight gap of a predefined minimum gap width to subsequent swaths, thereby splitting the image into segments, wherein each segment is assigned to a swath to be printed, and avoiding that the content of subsequent swath is closer than a predefined minimum gap width, thereby compensating or hiding alignment errors during printer runs.

Finally, the invention also provides a computer program product for printing multiple swaths with a hand-operated printer, the computer program product comprising program parts, which when loaded onto a computer are designed to perform the method steps of a method as described immediately above.

BRIEF DESCRIPTION OF THE DRAWINGS

Referring now to the drawings, wherein the figures are for purposes of illustrating the present invention and not for purposes of limiting the same, FIG. 1 schematically illustrates a simple application of the present method for printing to swaths of the same lengths and widths.

DETAILED DESCRIPTION OF THE PREFERRED EMBODIMENT

Figure 1:
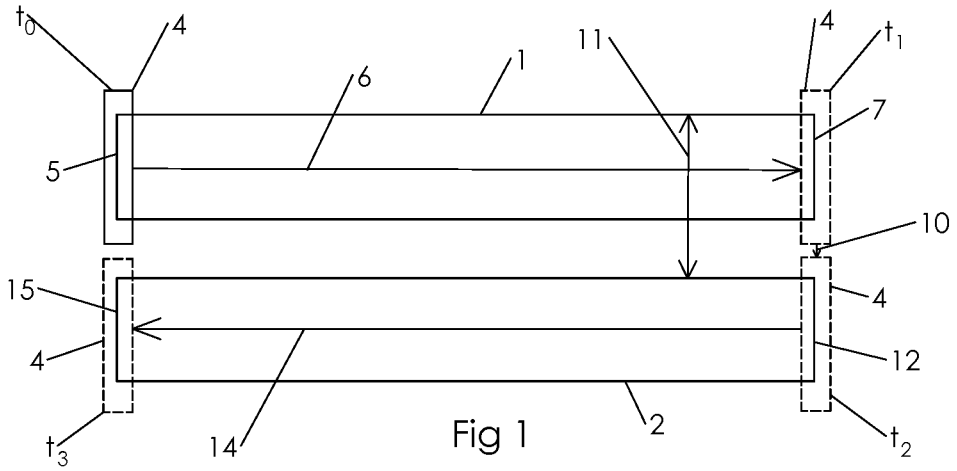
Figure 3:
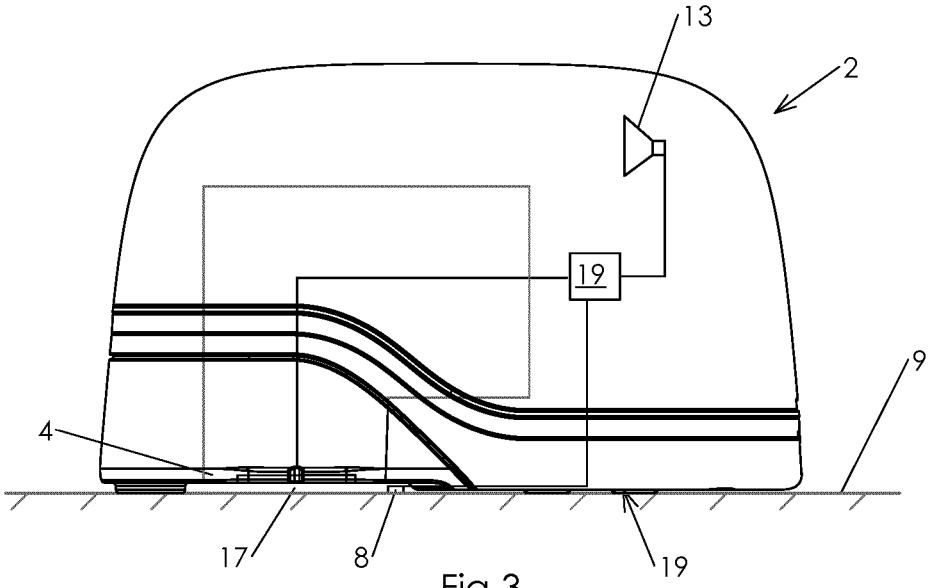
FIG. 3 schematically a vertical cut of a hand-operated printer according to the present invention.

FIG. 1 shows two swaths 1, 2 to be covered by the movement of a hand-operated printer 3 (see FIG. 3). Narrow upright rectangles indicate different positions of the printhead 4 of the hand-operated printer 3 at different times t0, t1, t2, t3 during a printing procedure. The printing procedure starts at time t0 with the printhead 4 positioned at the left border 5 of the first swath 1. In this position the printer 3 starts in print mode. Starting from here, the printer is moved in a longitudinal direction 6 toward the opposite border 7 of the first swath 1 in a longitudinal movement and arrives at said opposite border 7 at the time t1. Being in print mode, the printer 3 detects a longitudinal movement and controls the printhead 4 in accordance with the detected longitudinal movement to print an image content of a present swath 1. More specifically, an optical motion sensor 8 of the hand-operated printer 3 monitors the longitudinal movement by detecting a relative displacement between the hand-operated printer 3 and the target substrate 9 on which it prints. 10. The direction of the longitudinal movement is determined by the printer 3 during printing the first swath 1. A direction of the longitudinal movement during the second swath 2 is assumed to be inverse (or opposite) to the direction of the first swath, because the swaths are known to be transversely stacked with respect to each other.

At the time t1 the first swath 1 is finished and the printing procedure may continue with the second swath 2. The printer 3 is switched to translation mode. In this mode, the printhead is controlled to remain idle. The direction of transverse movement is indicated by an LED of the printer 3 after finishing the first swath 1.

In order to bring the printhead 4 in position, a transverse movement in a transverse direction 10 is necessary. The optical motion sensor 8 detects the transverse movement of the hand-operated printer 3 after finishing the upper swath 1. The transverse distance covered by the transverse movement is compared with a predetermined transverse distance 11 between the upper swath 1 and the lower swath 2. The predetermined transverse distance 11 corresponds to the distance the printhead must be moved in the transverse direction 10 in order to reach the beginning and right-hand border 12 of the lower swath 2. The predetermined transverse distance 11 is larger than the average swath width of the upper swath 1 and the lower swath 2, which equals the identical swath width W of both swaths 1, 2, by a predefined transverse padding P (see FIG. 2). Incidentally, the lengths 1 of the two swaths 1, 2 is also identical. The end of the upper swath 1, i.e. its right-hand border 7 is transversely aligned with the beginning, i.e. right-hand border 12, of the lower swath 2. When the transverse distance covered by the transverse movement reaches the predetermined transverse distance 11, at time t2, a transverse-stop signal in the form of a beep-sound is emitted by a signalling unit 13 of the hand-operated printer 3. At the same time, the hand-operated printer 3 is switched from translation mode into print mode. The user notices the transverse-stop signal at time t2 and stops the movement in the transverse direction 10. They then continued the printing procedure by moving the printer 3 in a second longitudinal direction 14, which is opposite to the longitudinal direction 6, towards the left-hand border 15 or end of the lower swath 2. At the time t3 the printhead 4 arrives at the left-hand border 15.

During the longitudinal movements between times t0 and t1 and between times t2 and t3, the printer 3 prints the image segments assigned to the respective swaths 1 and 2 in a manner known in the art and based on the readings of the optical motion sensor 8. At times t1 and t3, the end of each swath 1,2 is signalled by emitting a longitudinal-stop signal after finishing the respective swath 1, 2. As time t1, the printer 3 is switched from print mode into translation mode. The longitudinal-stop signal is a beep-sound at a different pitch than the transverse-stop signal. As can be recognised regarding FIG. 2, which shows the printed content 16 associated with each of the two swaths 1, 2, As is apparent from FIG. 3, the hand-operated printer 3 comprises an inkjet printhead 4 with nozzles 17 directed toward a bottom side 18 of the hand-operated printer 3 a facing the target medium 9, a control circuit 19, a motion detector 8 and a signalling unit 13. The control circuit 19 is connected to the motion detector 8, to the inkjet printhead 4 and to the signalling unit 13. The control circuit 19 is further configured to control the inkjet printhead 4 in response to readings received from the motion detector 8. The control circuit 19 is configured to monitor a transverse movement detected by the motion detector 8 between a first swath 1 and a second swath 2, compare a transverse distance covered by the transverse movement with a predetermined transverse distance 11 between said swaths 1, 2 and command the signalling unit 13 to emit a transverse-stop signal when the transverse distance covered by the transverse movement reaches the predetermined transverse distance 11. The control circuit 19 is configured to detect a direction of longitudinal movement for printing the first swath 1 and to assume alternating directions of longitudinal movement for the second swath 2 due to their transversely stacked arrangement. The signalling unit 13 is a speaker for producing beep sounds of different pitch.

Figure 2:
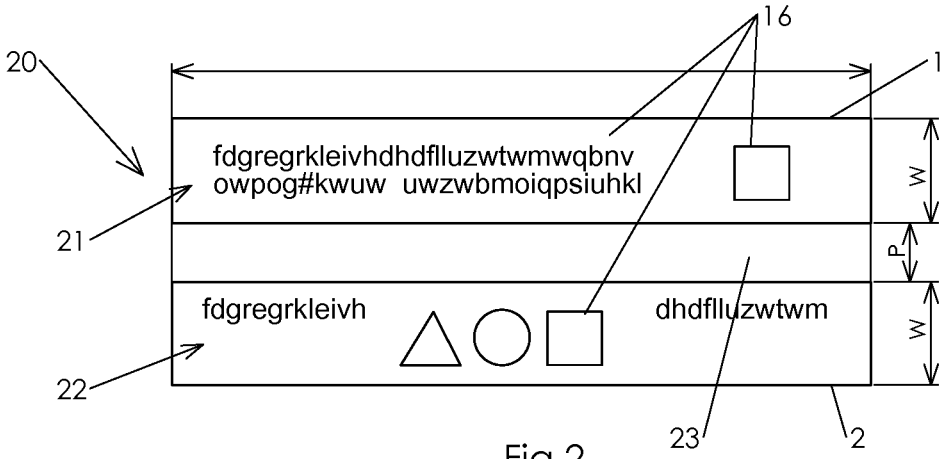
FIG. 2 schematically shows the content of the two swaths according to FIG. 1.

In order to prepare the hand-operated printer 3 for printing an image 20 in multiple swaths 1, 2 using the above method, in which image parts 21, 22 separated by a straight gap 23 of a predefined minimum gap width (e.g. 0.2 mm) are identified (see FIG. 2). Then, adjacent identified image parts 21, 22 are assigned to subsequent swaths 1, 2. Finally, the image data associated with each swath 1, 2 based on the assigned image parts 21, 22 and alignment information of all swaths 1, 2 is transmitted to the hand-operated printer 3.

Figure 4:
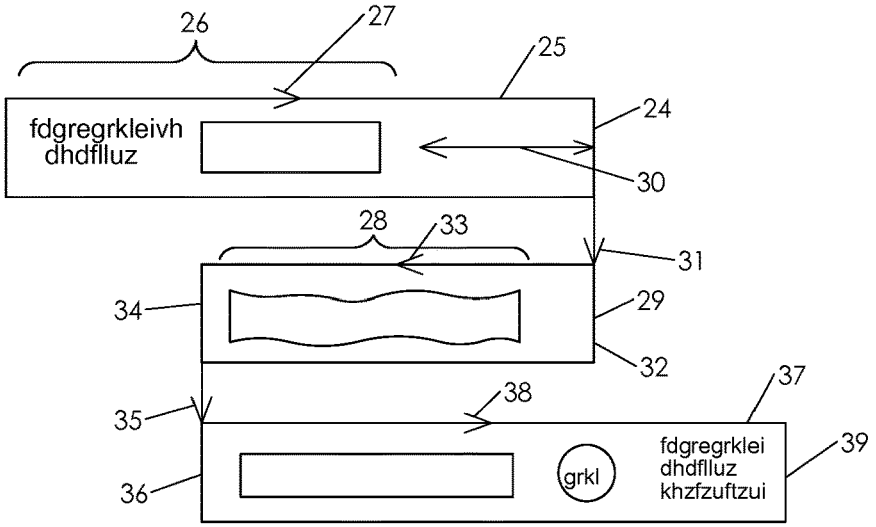
FIG. 4 schematically illustrates a second example of an application of the present method.

The example shown in FIG. 4 illustrates that the end 24 of the first swath 25—and hence signalling of the end—depends on the printed area 26 of the present swath 25, on a longitudinal direction 27 of movement of the hand-operated printer 3 and on the beginning of the printed area 28 of the second swath 29. In the present example, a longitudinal padding 30 is appended to the content of the first swath 25 in order to reach the desired end position 24. When the printhead 4 reaches the end 24, a longitudinal-stop signal is emitted. From there, a transverse movement in a transverse direction 31 is carried out to reach the beginning 32 of the second swath 29, at which moment a transverse-stop signal is emitted. The second swath 29 is printed by moving in a longitudinal direction 33 opposite to the longitudinal direction 27. At the end 34 of the second swath 29, again, a longitudinal-stop signal is emitted. The user moves the printer 3 in a transverse direction 35 until another transverse-stop signal is emitted when the printed 4 reaches the beginning 36 of the third swath 37. From there, the user moves the printer 3 in a longitudinal direction 38 until the end 39 of the third swath 37 is notified by a longitudinal-stop signal.

Figure 5:
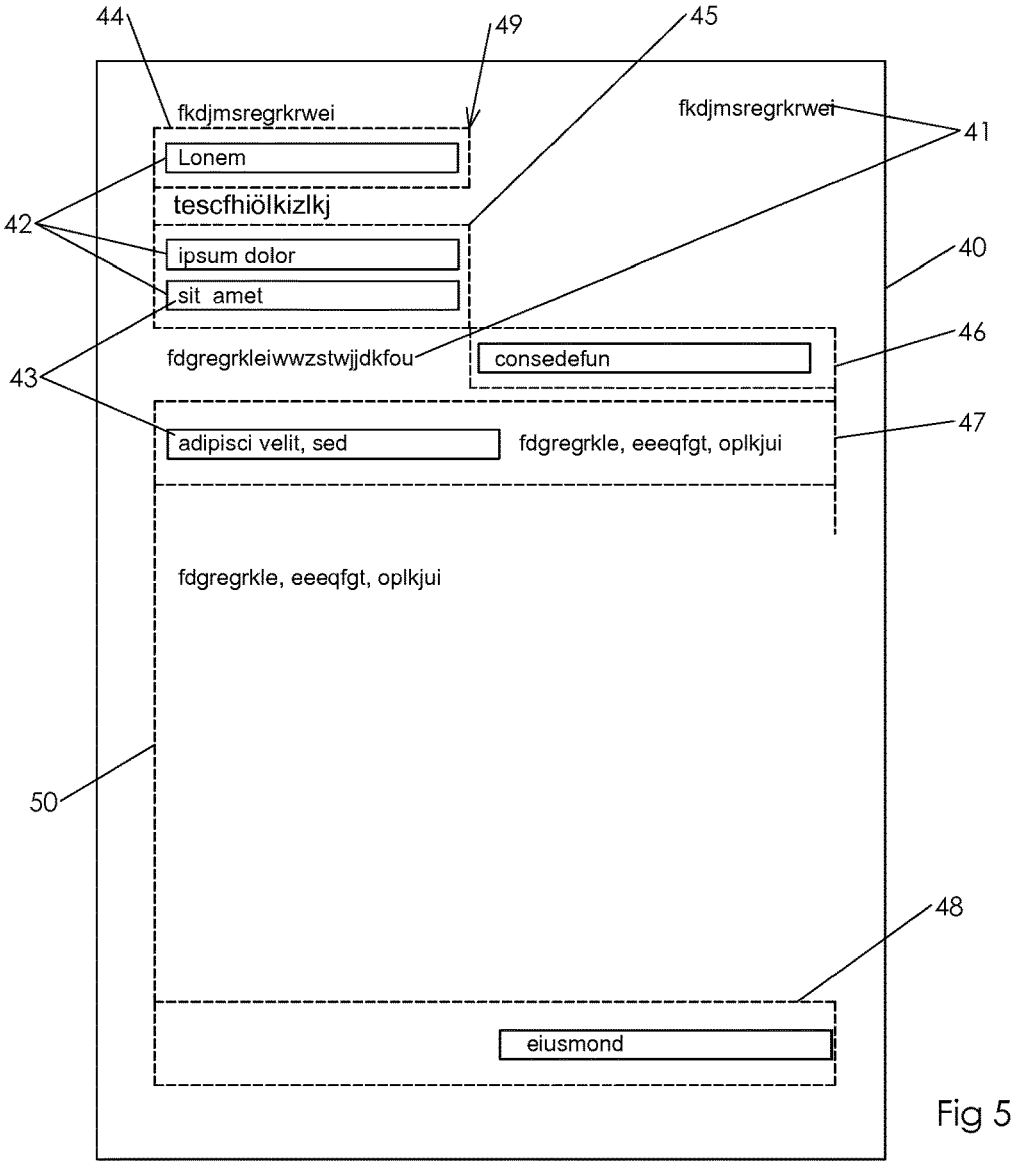
FIG. 5 schematically illustrates a third example, showing the application of the present method to fill in a pre-printed form sheet.

FIG. 5 shows a more comprehensive example of the present method for filling out a paper form sheet 40. The paper form sheet 40 comprises pre-printed content 41. Between the pre-printed concert 41, several form fields 42 are arranged. A user of the present hand-operated printer can fill in the form fields 42 with custom printed content 43 (represented by the common placeholder words "Lorem ipsum dolor . . . "). To do so, the image data of the custom printed content 43 is suitably assigned to five swaths 44-48. The hand-operated printer 3 is initially positioned at a right border 49 of the first swath 44. The printer 3 is then moved in turn eighteen longitudinal and transverse directions through the sequence of swaths from top to bottom. Notably, the direction of longitudinal movement of the second swath 45 and the subsequent third swath 46 is identical, showing that it is not necessarily the case that the direction of longitudinal movement alternates if the respective swaths are not transversely stacked on top of each other but rather also longitudinally displaced. As illustrated by the transverse movement 50 between the fourth swath 47 and the fifth swath 48, the transverse movement 50 may also cover transverse distances many times larger than the swath width.

The invention claimed is:

1. A method of controlling a hand-operated printer, comprising:

detecting a transverse movement of the hand-operated printer after finishing a first swath, comparing a transverse distance covered by the transverse movement with a predetermined transverse distance between said first swath and a second swath, and emitting a transverse-stop signal when the transverse distance covered by the transverse movement reaches the predetermined transverse distance.

2. The method according to claim 1 wherein the predetermined transverse distance is larger than an average swath width of the first swath and second swath by a predefined transverse padding.

3. The method according to claim 1, wherein the predetermined transverse distance is determined as a function of a path of a longitudinal movement of the hand-operated printer during printing the first swath.

4. The method according to claim 1, wherein the transverse-stop signal is an audible, visual or haptic signal.

5. The method according to claim 1, wherein at least one end of each swath but the last swath is transversely aligned with a beginning of an adjacent swath.

6. The method according to claim 1, wherein signalling an end of a swath by emitting a longitudinal-stop signal after finishing the first swath.

7. The method according to claim 6, wherein signalling the end of a swath depending on printed area of the present swath, on a longitudinal direction of movement of the hand-operated printer and on a beginning of the printed area of a subsequent swath.

8. The method according to claim 1, comprising switching the hand-operated printer between a print mode and a translation mode, in print mode detecting a longitudinal movement of the hand-operated printer and controlling a printhead of the hand-operated printer in accordance with the detected longitudinal movement to print an image content of a present swath, and in translation mode controlling the printhead to remain idle.

9. The method according to claim 8, comprising switching the hand-operated printer from translation mode into print mode at a same time as emitting the transverse-stop signal.

10. The method according to claim 8, wherein in print mode a direction of the longitudinal movement is determined during printing the first swath, wherein a direction of the longitudinal movement during subsequent swaths is assumed to be inverse to the direction of the previous swath.

11. A hand-operated printer comprising:

an inkjet printhead with nozzles directed toward a bottom side of the hand-operated printer, a control circuit, and a motion detector, wherein the control circuit is connected to the motion detector and to the inkjet printhead and configured to control the inkjet printhead in response to readings received from the motion detector, wherein the hand-operated printer further comprises a signalling unit connected to the control circuit, wherein the control circuit is configured to monitor a transverse movement detected by the motion detector between a first swath and a second swath, compare a transverse distance covered by the transverse movement with a predetermined transverse distance between said swaths and command the signalling unit to emit a transverse-stop signal when the transverse distance covered by the transverse movement reaches the predetermined transverse distance.

12. The hand-operated printer according to claim 11, wherein the signalling unit is a speaker, a light or a vibration motor.

13. A computer program product for printing multiple swaths with a hand-operated printer, the computer program product comprising program parts, which when loaded onto a computer are designed to perform the method steps of a method according to claim 1.

14. A method for preparing a hand-operated printer for printing an image in multiple swaths using a method according to claim 1, comprising:

identifying image parts separated by parallel straight gaps of a predefined minimum gap width, assigning adjacent identified image parts to subsequent swaths, transmitting image data associated with each swath and alignment information of all swaths to a hand-operated printer.

15. A computer program product for printing multiple swaths with a hand-operated printer, the computer program product comprising program parts, which when loaded onto a computer are designed to perform the method steps of a method according to claim 14.

* * * * *